United States Patent [19]

Holt

[11] 4,172,536

[45] Oct. 30, 1979

[54] COLLAPSIBLE TUBE DISPENSER

[76] Inventor: Roger A. Holt, 199 Kilby Rd., Kew, Victoria, Australia, 3101

[21] Appl. No.: 911,191

[22] Filed: May 30, 1978

[30] Foreign Application Priority Data

Jun. 9, 1977 [AU] Australia ..... PD0392

[51] Int. Cl.[2] ..... B65D 35/28

[52] U.S. Cl. ..... 222/103

[58] Field of Search ..... 222/103, 95, 96, 105, 222/107

[56] References Cited

U.S. PATENT DOCUMENTS

| | | | |
|---|---|---|---|
| 3,450,309 | 6/1969 | Millo | 222/103 |
| 3,768,699 | 10/1973 | Robe | 222/103 |
| 3,893,590 | 7/1975 | Paroussiadis | 222/103 |

*Primary Examiner*—Allen N. Knowles

*Attorney, Agent, or Firm*—Cushman, Darby & Cushman

[57] ABSTRACT

A dispenser for toothpaste and the like having a V-shaped one-piece plastics body portion and a retaining portion for receiving the neck of the toothpaste tube. The body and retaining portions are connected to one another by connecting means comprising at least one male connecting component on one portion and at least one female connecting component on the other portion. The two components are co-operable for slidably connecting the two portions to retain the tube in the dispenser. Each arm may be a substantially flat strip sufficiently rigid to evenly distribute pressure applied to the arms at one point, over the length of the tube.

16 Claims, 5 Drawing Figures

COLLAPSIBLE TUBE DISPENSER

BACKGROUND OF THE INVENTION

The present invention relates to a dispenser and more particularly to a dispenser for use in dispensing commodities packaged in tubes.

It has long been known to package a wide variety of commodities in collapsible tubes. Such collapsible tubes exhibit certain advantages over other packaging methods but it can be difficult to fully evacuate the tube. Toothpaste is often quoted to exemplify such difficulties. The problems associated with squeezing a toothpaste tube in the middle, rather than systematically beginning at the end remote from the outlet and squeezing the paste toward the outlet, are well known and require no further explanation. A number of dispensers have been proposed in the past some of them being specifically designed for dispensing toothpaste. Some of the known dispensers operate on the principle of passing the tube between a pair of rollers or camming surfaces whereby to squeeze the contents of the tube toward the outlet. A key or knurled knob is usually provided to operate such dispensers. However, the dispensers are often inconvenient and difficult to operate. For example, when toothpaste is to be dispensed the dispenser must be supported, the key or knob turned to squeeze paste from the tube and the toothbrush positioned at the tube outlet. This manoeuvre requires three separate and distinct operations and thus either the dispenser or the brush need to be supported by a wall, bench, shelf etc. leaving the hands free to perform the remaining two operations. It has been proposed to overcome such difficulties by affixing the dispenser to a wall as shown for example in U.S. Pat. No. 2,537,008 (Abbott). However, the convenience and adaptibility of such fixed dispensers is severely limited.

Hand-held dispensers previously proposed are exemplified by U.S. Pat. Nos. 1,510,848 (Hubbard); 1,876,489 (Collins); and 2,759,636 (Albert). All of these dispensers, however, suffer from one or more difficulties. For example, Collins and Albert both propose separate arms hingedly connected to one another. Such hinges are relatively expensive to manufacture and join, and the hinge provides a point of potential weakness. In addition, the closure or other means for retaining the tube between the arms has often proved a potential difficulty. In Albert, for example, slots are provided to receive the end of the tube, however such slots tend to weaken the arm. In addition a weakness may develop in the wall of the tube adjacent the fold which may cause the wall to split and allow the contents to escape. In Collins the arms are encased by an outer body. This requires additional materials and fabricating and hence results in increased costs. Further, there in no positive connection between the closure and the body so that clearance tolerances become critical for efficient operation.

In Hubbard the closure is permanently in place making it difficult to insert a tube into the dispenser. Further in this proposal the position of the neck may alter as the arms are squeezed together.

Although it is many years since dispensers of the present type were first proposed deficiencies still exist in the known prior art and accordingly there still exists a need for a dispenser which is simple and efficient to load and operate and which is relatively easy and cheap to produce in volume.

SUMMARY OF THE INVENTION

It is an object of the present invention to fulfil that need by providing a dispenser suitable for commodities packaged in tubes which is capable of alleviating the above described disadvantages of the known prior art.

It is another object of the invention to provide a dispenser which is relatively simple and economical to produce in volume.

Yet another object of the invention is to provide a two-piece dispenser in which there is a positive and slidable connection between the two pieces.

A still further object of the invention is to provide a dispenser for tube packaged commodities comprising:

a one-piece, plastics, body portion having a pair of hingedly connected arms capable of adopting a V-shaped configuration when in a relaxed condition; and a retaining portion having an aperture for receiving the neck of a tube; wherein one of the body or retaining portions carries at least one male connecting component and the other of the portions carries at least one female connecting component, the male and female connecting components being co-operable to form connecting means for slidably connecting the body portion with the retaining portion to retain a tube in said dispenser.

These and other objects of the invention will become apparent from the following description which refers in more detail to the essential and optional features of the invention. To facilitate understanding of the invention, reference is made to the accompanying drawings where these features are illustrated in preferred form. It is to be understood however, that the essential and optional features of the invention are not limited to the specific forms of those features shown in the drawings.

DETAILED DESCRIPTION OF THE INVENTION

Figure 1:
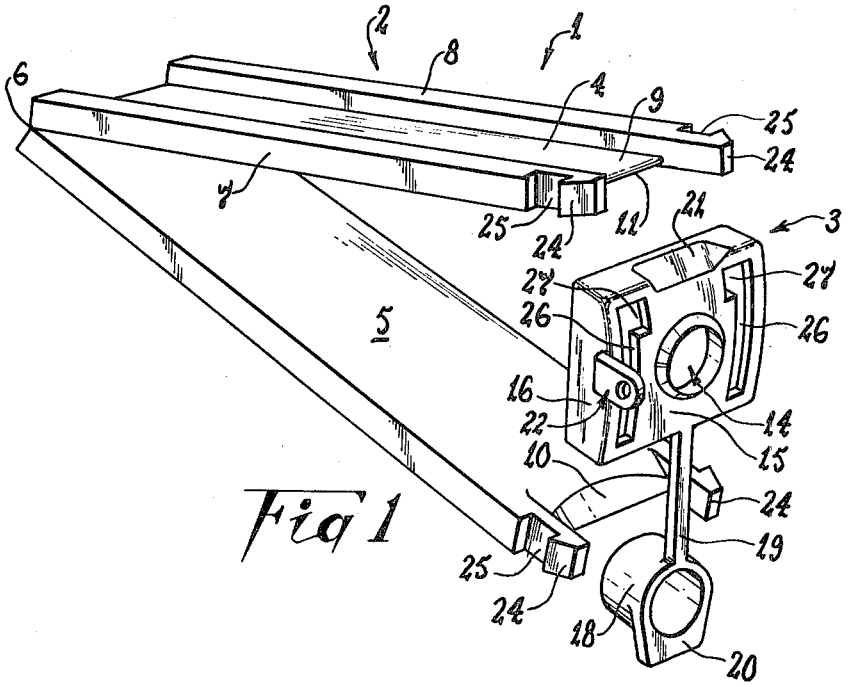
FIG. 1 is a perspective view of a dispenser according to one embodiment of the invention.
Figure 3:
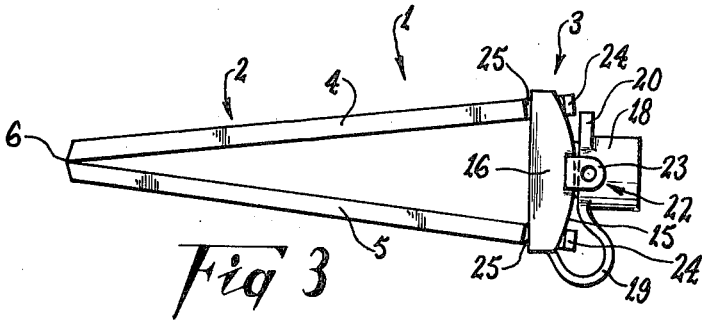
FIG. 3 is a side view of the embodiment of FIG. 1 also with the cap closed.
Figure 2:
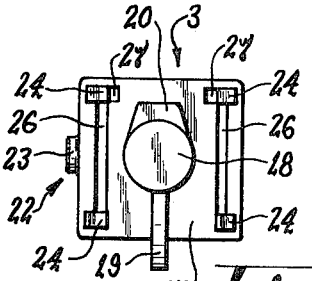
FIG. 2 is an end view of the embodiment of FIG. 1 with the cap shown in the closed position.

FIGS. 1 to 3 show one embodiment in which the dispenser 1 has a body portion 2 and a retaining portion 3. Body portion 2 comprises a pair of arms 4, 5 connected by a hinge 6 which is composed of a strip of plastics material.

In a relaxed position arms 4, 5 adopt a V-shape as shown in FIGS. 1 and 3.

Each arm of a dispenser according to the invention is preferably in the form of a substantially flat strip. The strip is preferably sufficiently resilient that pressure applied at any point on the outer surface of the arm is spread substantially evenly over the inner surface of the arm. Thus the pressure is applied substantially evenly to the areas of the tube in contact with the inner surface of the arm. It may also be convenient for the arms to be sufficiently pliable for a greater pressure to be exerted on a tube in the region adjacent the point of application of pressure to the tube.

FIG. 1 illustrates an embodiment in which the arms 4, 5 each comprise a pair of spaced runners 7, 8 extending longitudinally of the arm. The pair of runners, which are preferably substantially rigid, may form the edges of the arm as shown in FIG. 1. An interconnecting web 9, preferably formed from pliable material, may extend between the runners 7, 8. The inner surface of each arm, i.e. the surface adapted to contact a tube housed in the dispenser, may be substantially flat or may be domed or otherwise shaped to co-operate with the shape of the outer surface of the tube. The runners may be of any cross-sectional shape. Square or rectangular runners 7, 8 as shown in FIG. 1 are preferred as such shapes give additional strength and rigidity to the arm.

Arcuately curved recesses 10, 11 may be provided adjacent the outer ends of the arms i.e. the ends remote from hinge 6, to facilitate the efficient emptying of the tube without damage to the tube wall in the area of the shoulder.

One (or both) of the arms 4, 5 may also carry one or more pairs of fingers 12, 13, so that a toothbrush may be conveniently clipped to the dispenser. Other means for clipping a toothbrush to one or both arms are also envisaged within the scope of the invention.

The body portion 2 comprising the arms 4, 5 connected by hinge 6 is formed as a one piece plastics molding. Polypropylene is considered to be one material suitable for forming body portion 2. Other similarly suitable materials will be apparent to those skilled in the art.

The retaining portion 3 of dispenser 1 may be adapted to retain a tube between the pair of hingedly connected arms 4, 5. Retaining portion 3 may contain an aperture 14 for receiving the neck of the tube. Aperture 14 may be adapted for locking engagement with the tube neck such as by forming a friction fit with the tube neck or by being threaded for engagement with the thread of the tube neck. Other adaptions are also contemplated within the scope of the invention.

Retaining portion 3 may comprise a base portion 15 which is preferably substantially rectangular when viewed in plan and may have a depending skirt 16 extending from the edges of the rectangle. Depending skirt 16 may be adapted to receive the shoulder of a tube when the neck thereof extends through aperture 14. Accordingly, the inner and/or outer surfaces of the base portion 15 may be domed (as shown in FIGS. 4 and 5) or otherwise shaped to be complementary to the shape of a tube shoulder.

Figure 4:
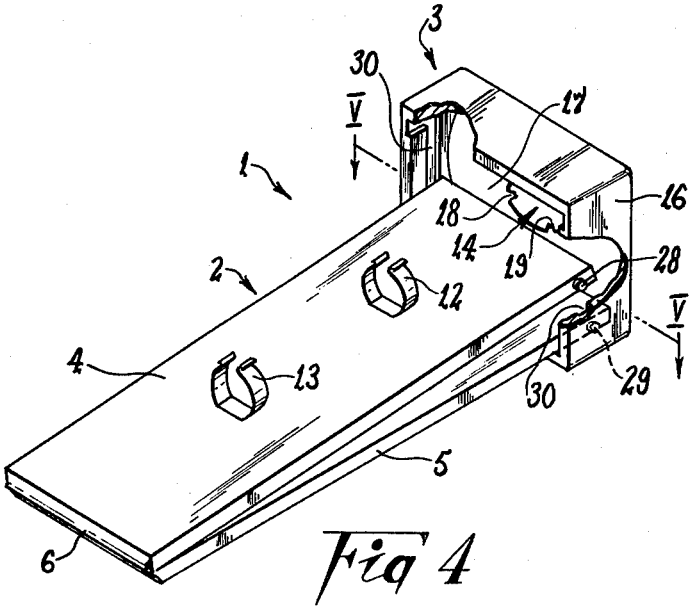
FIG. 4 is a perspective view of an alternative embodiment partly broken away to show the connecting means.
Figure 5:
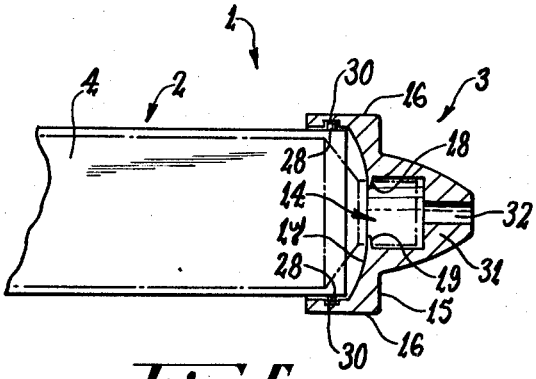
FIG. 5 is a cross-sectional view along the line V—V of FIG. 4.

FIGS. 4 and 5 show such an alternative embodiment in which the retaining portion 3 has a rectangular base portion 15 having a domed inner surface 17 and a depending skirt 16. The embodiment shown in FIGS. 4 and 5 also includes flanges 18, 19 which project inwardly into aperture 14 and engage the screw threads on the neck of the tube. In a particularly preferred embodiment there are four such flanges circumferentially spaced around the aperture. The flanges may be formed from plastics material and are preferably deformable upon engagement with the threaded neck of a tube.

In Australia, toothpaste tubes generally have one of two standard neck sizes—0.375" for smaller tubes and 0.450" for larger tubes. Thus, for example, if the diameter of the aperture is approximately 0.450" and deformable circumferentially spaced flanges each project inwardly from the marginal edges of the aperture by 0.050" the retaining portion can receive both the large and smaller standard sized necks.

The retaining portion 3 may also be provided with a cap 18 for the tube 1. Cap 18 is preferably attached to retaining portion 3 by a flexible strap 19. Conveniently cap 18 is adapted to form a friction fit with a tube neck extending through aperture 14 and may contain a tab 20 to facilitate removal from the tube neck. FIG. 3 shows cap 18 in its closed position. A bevel 21 may be formed in at least part of retaining portion 3 to facilitate access to the tab 20. Thus, for convenience, bevel 21 may be arranged so that a thumb nail can be easily inserted under tab 20 and pressure applied on tab 20 to remove cap 18 from the tube.

Retaining portion 3 may also be provided with hanging means 22 adapted for hanging the dispenser on a wall or similar support. Such hanging means 22 is convenient for tidy storage of the dispenser when not in use. Conveniently hanging means 22 is in the form of an apertured ear 23 extending outwardly from the retaining portion 3. However other hanging means may also be provided in accordance with the invention.

The retaining portion 3 is preferably formed as a one piece plastics molding and like body portion 2 may be formed from polypropylene or other suitable materials as will be appreciated by those skilled in the art.

Body portion 2 and retaining portion 3 are connectable by connecting means which may take a number of forms and which enable slidable connection of the retaining and body portions to enable a tube to be retained within the dispenser.

The connecting means comprises at least one male connecting component carried by either the body or retaining portion and at least one female connecting component carried by the other portion. The connecting means enable the arms of the body portion to be squeezed toward one another as allowed by the hinge.

Preferably the retaining portion carries at least one female connecting component and the body portion carries a complementary pair of male connecting components each pair being engageable with a single female component. The female component may comprise an elongated slot or an elongated groove. The male components may each comprise an extension from an arm. The extension may be in the form of a lug or nib for engaging a groove or it may be in the form of a head portion for projecting through a slot. Preferably a locking groove for engaging the edges of the slot separates the head portion from the arm.

Two different forms of connecting means are shown in the drawings.

In one preferred embodiment the male components are formed by an extension from one of the arms 4, 5 and preferably as shown in FIGS. 1 to 3 comprise extensions of the runners 7, 8 beyond associated connecting web 9. Preferably such extension is made of all four runners of body portion 2. Each extension preferably includes a bevelled or tapered head portion 24 to facilitate alignment and engagement with the co-operating female component.

A locking groove 25 may separate head portion 24 from the arm. Preferably each locking groove 25 faces outwardly away from the longitudinal axis of the arm i.e. toward the outer edge of the arm.

Each female connecting component may comprise an elongated slot 26, adapted to receive one or more male connecting components. The female connecting components may conveniently be arranged as shown in FIGS. 1 to 3 to facilitate slidable movement of the associated male connecting components along slot 26 as the arms 4, 5 are squeezed toward one another so as to close the V. The preferred form of elongated slot illustrated contains a widened portion 27 so that one head portion 24 of a male connecting component may be passed through widened portion 27 to enable locking groove 25 to engage the marginal edge of slot 26. Conveniently widened portion 27 is positioned, as shown in FIGS. 1 to 3, at one end of elongated slot 26 whereby to provide a substantially L-shaped connecting component. More than one widened portion may be provided and a substantially U-shaped connecting component comprising widened portions at either end of the elongated slot may also be usefully employed.

When locking groove 25 faces outwardly as shown each widened portion 27 preferably extends inwardly of elongated slot 26 and thus toward the centre of retaining portion 3. Thus for engagement of a male and female component according to the preferred embodiment illustrated, it is necessary to squeeze the head portions 24 towards one another so as to pass the head portions 24 through the widened portions 27 of slots 26 and when the locking grooves 25 engage the edges of slots 26 the pressure may be relaxed so that the head portions 24 return to their relaxed position in which each male connecting component is in locking engagement with its co-operating female connecting component. Gentle pressure on the edges of each arm 4, 5 should provide the necessary movement of the head portions. If desired web 9 may be slightly domed to facilitate such movement and so as to more closely conform to the outer shape of a tube.

Preferably each elongated slot is arranged as illustrated to receive a pair of head portions, one on each arm. However other arrangements are also envisaged. For example, a separate slot may be provided for each head portion or the retaining portion may be hingedly connected to one of the arms and male or female connecting components may be provided on the other arm for connection with complementary female or male connecting components on the retaining portion. Those skilled in the art will no doubt appreciate other arrangements which may be provided in accordance with the invention.

One such alternative arrangement which is particularly preferred is shown in FIGS. 4 and 5. In this embodiment arms 4, 5 each have male connecting components 28, 29 in the form of a nib extending outwardly from their outer edges. The nibs may be in the form of a lug moulded integrally with the arm or in the form of a metal post partially embedded in the arm. Retaining portion 3 carries a pair of female connecting components. One of these female connecting components is visible in FIG. 4 and it comprises a substantially L-shaped groove 30 on an inner face of depending skirt 16. A corresponding groove is provided on the inner face of that part of skirt 16 which is broken away in FIG. 4.

Male connecting components 28, 29 are thus free to slide along their respective grooves 30 as arms 4, 5 are forced toward one another to dispense the contents of the tube.

FIGS. 1 to 3 show an aperture through which the tube neck may project. FIG. 5 clearly shows an alternative arrangement in which retaining portion 3 carries a nozzle 31 which covers the tube neck projecting through aperture 14. Nozzle 31 has a bore 32 for dispensing the contents of the tube. A cap of the type shown in FIG. 1 may be shaped to fit over the nozzle to close it when the dispenser is not in use. Such a nozzle 31 may be convenient for accurate placement of the commodity being dispensed from the tube.

To operate the preferred form of the invention shown in FIGS. 1 to 3 the pair of head portions 24 on the runners 7, 8 of arm 4 are positioned at the widened portions 27 of their respective slots 26. Gentle pressure is applied to the runners 7, 8 of arm 4 to move the head portions 24 toward one another. The head portions 24 are then disengaged from their respective grooves 25 so as to "open" the retaining portion 3 and body portion 2 for receiving a tube. The other arm 5 may remain connected to the retaining portion 3 or may be removed by a similar procedure if preferred. The cap 18 of the tube is removed and discarded. The tube is then inserted into the dispenser. The tube is inserted in such a way that the body of the tube is positioned between the V-shaped arms 4, 5 and the neck of the tube is passed through the aperture 14 in retaining portion 3. The shoulder of the tube is thus received within depending skirt 16. As the neck is being passed through aperture 14 the head portions 24 of free arm 4 are aligned with the widened portions 27 of the L-shaped slots 26 so that head portions 24 engage slots 26 as the neck is inserted through aperture 14. Thus when the retaining portion 3 is in position the head portions 24 form a snap fit with slots 26. The cap 18, which is attached to retaining portion 3 by strap 19, is then placed over the neck of the tube.

The dispenser provided by the present invention may be conveniently molded from plastics materials by presently known techniques and is relatively light and easy to use. The broad flat arms are ideal for carrying instructions for use of the dispenser or advertising or other material. It is not important where pressure is applied on the arms since the rigidity of the arms tends to spread the pressure substantially evenly over the sides of the tube and the hinged connection facilitates efficient emptying of the tube beginning at the foot of the tube remote from the neck even if the pressure is always applied at the same position on the arm. The dispenser can be conveniently operated with one hand thereby leaving the other hand free to hold a toothbrush for example. Accordingly, the dispenser provided by the invention is both adaptable and portable and need not be affixed to a support for efficient use.

Various alterations, modifications and/or additions may be incorporated into the invention particularly described without departing from the spirit or scope of the invention as defined by the following claims.

Having now described my invention, what I claim as new and desire to secure by Letters Patent is:

1. A dispenser for tube packaged commodities comprising:

a one-piece, plastics, body portion having a pair of hingedly connected arms capable of adopting a V-shaped configuration when in a relaxed condition; and a retaining portion having an aperture for receiving the neck of a tube; wherein one of said body or retaining portions carries at least one male connecting component and the other of said portions carried at least one female connecting component, said male and female connecting components being co-operable to form connecting means for slidably connecting said body portion with said retaining portion whereby to retain a tube in said dispenser; and wherein each connecting component carried by the retaining portion is elongated whereby as said arms are squeezed from said V-shaped configuration toward one another to dispense the contents of a tube retained in the dispenser the co-operating male and female connecting components slide relative to one another.

2. A dispenser according to claim 1 wherein the retaining portion carries at least one female connecting component and the body portion carries a complementary pair of male connecting components engageable with said female component.

3. A dispenser according to claim 2 wherein each said female component comprises an elongated slot adapted to receive one or more male components by the provision of a widened portion adjacent one end of said slot whereby to provide a substantially L-shaped slot.

4. A dispenser according to claim 3 wherein each said male component comprises an extension from an arm said extension including a tapered head portion separated from said arm by a locking groove said locking groove engaging the marginal edge of said slot during use.

5. A dispenser according to claim 3 wherein said aperture includes at least one inwardly projecting flange for engaging the screw thread on the neck of a tube.

6. A dispenser according to claim 3 wherein said retaining portion comprises a skirt depending from the edges of a substantially rectangular base said skirt being adapted to receive the shoulder of a tube when the neck thereof extends through the aperture.

7. A dispenser according to claim 6 wherein said L-shaped slot is in said base.

8. A dispenser according to claim 7 wherein said retaining portion includes a nozzle for dispensing the contents squeezed from the tube within the dispenser.

9. A dispenser for tube packaged commodities comprising:

a one-piece, plastics, body portion having a pair of hingedly connected arms capable of adopting a V-shaped configuration when in a relaxed condition; and a retaining portion having an aperture for receiving the neck of a tube; wherein one of said body or retaining portions carries at least one female connecting component and the other of said portions carries a complementary pair of male connecting components each comprising a nib extending outwardly from the edge of an arm in the same plane as the arm and each engageable with said female connecting component to form connecting means for slidably connecting said body portion with said retaining portion whereby to retain a tube in said dispenser; and wherein each said female connecting component comprises an elongated groove adapted to receive said pair of male connecting components whereby as said arms are squeezed from said V-shaped configuration toward one another to dispense the contents of a tube retained in the dispenser the co-operating male and female connecting components slide relative to one another.

10. A dispenser according to claim 1 wherein the retaining portion carries said at least one female connecting component and the body portion carries a separate said complementary pair of male connecting components engageable with each said female components.

11. A dispenser according to claim 10 wherein each said nib comprises a metal stud partially embedded in an arm.

12. A dispenser according to claim 10 wherein said aperture includes at least one inwardly projecting flange for engaging the screw thread on the neck of a tube.

13. A dispenser according to claim 10 wherein said retaining portion comprises a skirt depending from the edges of a substantially rectangular base said skirt being adapted to receive the shoulder of a tube when the neck thereof extends through the aperture.

14. A dispenser according to claim 13 wherein each said female component comprises an elongated groove on an inner face of said depending skirt.

15. A dispenser according to claim 14 wherein said retaining portion includes a nozzle for dispensing the contents squeezed from the tube within the dispenser.

16. A dispenser for tube-packaged toothpaste comprising:

a one-piece, plastics, body portion having a pair of substantially flat, resilient, hingedly connected arms capable of adapting a V-shaped configuration when in a relaxed condition, each said arm carrying adjacent the free end a nib extending outwardly from each of the opposed edges; and a retaining portion comprising a skirt depending from the edges of a substantially rectangular base, said skirt being adapted to receive the shoulder of a tube when the neck thereof extends through the aperture, said skirt carrying on each of two opposed inner faces, an elongated groove for slidably receiving a pair of said nibs, each of said pair being carried by a different one of said arms;

and wherein said nibs are engaged with their respective grooves so as to be free to slide therealong as said arms are squeezed from said V-shaped configuration toward one another to dispense the contents of a tube retained in the dispenser.

* * * * *